US008656839B2

(12) United States Patent
Nishimura et al.

(10) Patent No.: US 8,656,839 B2
(45) Date of Patent: Feb. 25, 2014

(54) RAILCAR BOGIE

(75) Inventors: Takehiro Nishimura, Kobe (JP); Shunichi Nakao, Kobe (JP); Takeyoshi Kusunoki, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 18 days.

(21) Appl. No.: 13/501,190

(22) PCT Filed: Apr. 7, 2011

(86) PCT No.: PCT/JP2011/002072

§ 371 (c)(1), (2), (4) Date: Apr. 10, 2012

(87) PCT Pub. No.: WO2012/137257

PCT Pub. Date: Oct. 11, 2012

(65) Prior Publication Data

US 2012/0279416 A1 Nov. 8, 2012

(51) Int. Cl.

*B61F 5/52* (2006.01)
*B61F 5/30* (2006.01)
*B61F 5/38* (2006.01)

(52) U.S. Cl.

USPC ..... 105/197.1; 105/218.1; 105/182.1

(58) Field of Classification Search

USPC ..... 105/197.1, 224.1, 182.1, 197.05, 218.1, 105/218.2; 267/270; 295/37

See application file for complete search history.

(56) References Cited

U.S. PATENT DOCUMENTS 1,508,954 A * 9/1924 Broussouse ..... 105/197.05
2,089,110 A 8/1937 Bugatti
3,806,148 A * 4/1974 Boulton ..... 280/680
3,945,325 A * 3/1976 Zehnder ..... 105/167
4,487,133 A * 12/1984 Eggert, Jr. ..... 105/224.1
6,250,232 B1 6/2001 Hachmann et al.
6,305,297 B1 10/2001 Landrot
2006/0231993 A1 * 10/2006 Collyer et al. ..... 267/270

FOREIGN PATENT DOCUMENTS

EP 0 601 677 A1 6/1994
JP Y1-44-23122 9/1969
JP B1-49-40801 11/1974

(Continued)

OTHER PUBLICATIONS

International Search Report mailed May 24, 2011 issued in International Patent Application No. PCT/JP2011/002072 (with translation).

*Primary Examiner* — Mark Le
(74) *Attorney, Agent, or Firm* — Oliff PLC

(57) ABSTRACT

A railcar bogie includes: a cross beam configured to support a carbody; a pair of front and rear axles respectively provided on front and rear sides of the cross beam so as to extend along a crosswise direction; bearings respectively provided on both crosswise-direction sides of each of the axles and configured to rotatably support the axles; bearing accommodating portions configured to respectively accommodate the bearings; and plate springs extending in a front-rear direction so as to be respectively supported by both crosswise-direction end portions of the cross beam, end portions of each of the plate springs being respectively supported by the bearing accommodating portions. Each of the bearing accommodating portions includes: a case portion configured to accommodate the bearing; and supporting portions configured to support the plate springs. The plate springs are supported by the supporting portions on a center side of the axle in the front-rear direction.

11 Claims, 12 Drawing Sheets

(56) References Cited

FOREIGN PATENT DOCUMENTS

| | | | |
|---|---|---|---|
| JP | A-55-47950 | | 4/1980 |
| JP | U-55-161754 | | 11/1980 |
| JP | U-56-152763 | | 11/1980 |
| JP | 58-124840 | * | 7/1983 |
| JP | A-1-168562 | | 7/1989 |
| JP | U-4-119266 | | 10/1992 |
| JP | B2-2799078 | | 9/1998 |
| JP | A-2000-502974 | | 3/2000 |
| WO | WO 01/32490 A1 | | 5/2001 |

* cited by examiner

L2: LOW LOAD

L1: HIGH LOAD

L0: NORMAL LOAD

RAILCAR BOGIE

TECHNICAL FIELD

The present invention relates to a railcar bogie from which side sills are omitted.

BACKGROUND ART

A bogie for supporting a carbody of a railcar and allowing the railcar to run along a rail is provided under a floor of the carbody. The bogie is supported by a primary suspension such that axle boxes each configured to store a bearing for supporting an axle can be displaced in a vertical direction relative to a bogie frame. Generally, the bogie frame includes a cross beam extending in a crosswise direction and a pair of left and right side sills respectively extending from both end portions of the cross beam in a front-rear direction. The primary suspension includes an axle spring constituted by a coil spring provided between the axle box and the side sill located above the axle box (see PTL 1).

According to the bogie as in PTL 1, the bogie frame including the cross beam and the side sills are manufactured by, for example, welding heavyweight steel materials one another. Therefore, problems are that the bogie frame increases in weight, and steel material cost and assembly cost increase. Here, proposed is the bogie in which the side sills are omitted from the bogie frame (see PTL 2). In the bogie of PTL 2, the bogie frame and the axle box are connected to each other by a support mechanism member while maintaining a certain distance between the bogie frame and the axle box. In addition, plate springs extending in the front-rear direction are respectively attached to both end portions of the cross beam of the bogie frame, and both end portions of each of the plate springs are respectively inserted in spring receivers each provided at a lower portion of the axle box.

CITATION LIST

Patent Literature

PTL 1: Japanese Patent No. 2799078

PTL 2: Japanese Laid-Open Patent Application Publication No. 55-47950

SUMMARY OF INVENTION

Technical Problem

In the bogie of PTL 2, the plate spring is supported by the axle boxes each located at a position immediately above or immediately under the axle. Therefore, the length of the plate spring is required to correspond to a distance between front and rear axles. However, if the plate spring increases in length, the spring constant becomes small. If the carbody is large in weight, the spring constant may be inadequate. If the plate spring is increased in thickness as a countermeasure, the spring constant becomes large. However, this increases the weight of the plate spring and takes away the effect of weight reduction realized by omitting the side sills. In a case where both end portions of the plate spring are respectively supported by the spring receivers each provided immediately under the axle box, the distance between the plate spring and a rail, a track, or the like (hereinafter simply referred to as "ground") becomes short, and obstacles and the like may contact the plate spring. Therefore, this may be inconvenient for the running of the railcar.

Here, an object of the present invention is to provide a railcar bogie capable of realizing a preferable spring constant without excessively increasing the thickness of the plate spring.

Solution to Problem

The present invention was made in consideration of the above circumstances, and a railcar bogie according to the present invention includes: a cross beam configured to support a carbody of a railcar; a pair of front and rear axles respectively provided on front and rear sides of the cross beam so as to extend along a crosswise direction; bearings respectively provided on both crosswise-direction sides of each of the axles and configured to rotatably support the axles; bearing accommodating portions configured to respectively accommodate the bearings; and plate springs extending in a front-rear direction so as to be respectively supported by both crosswise-direction end portions of the cross beam, end portions of each of the plate springs being respectively supported by the bearing accommodating portions, wherein each of the bearing accommodating portions includes a case portion configured to accommodate the bearing and a supporting portion configured to support the plate spring, and each of the plate springs is supported by the supporting portion on a center side of the axle in the front-rear direction.

According to the above configuration, since the plate spring is supported by the supporting portion of the bearing accommodating portion on the center side of the axle in the front-rear direction, the length of the plate spring can be reduced. Thus, even if the weight of the carbody is large, a preferable spring constant can be realized without excessively increasing the thickness of the plate spring. A position where the plate spring is supported by the bearing accommodating portion is shifted toward the center side of the axle in the front-rear direction. Therefore, the distance between the plate spring and the ground can be adjusted so as not to be too short. Thus, the running of the railcar is not adversely affected. In addition, since the position where the plate spring is supported by the bearing accommodating portion is shifted toward the center side of the axle in the front-rear direction, the plate spring can be provided at a low position, and this can lower the position of the cross beam. Thus, the low floor of the carbody can be realized.

Advantageous Effects of Invention

As is clear from the above explanation, the present invention can provide a railcar bogie capable of realizing a preferable spring constant without excessively increasing the thickness of the plate spring.

DESCRIPTION OF EMBODIMENTS

Hereinafter, embodiments according to the present invention will be explained in reference to the drawings.

Embodiment 1

Figure 1:
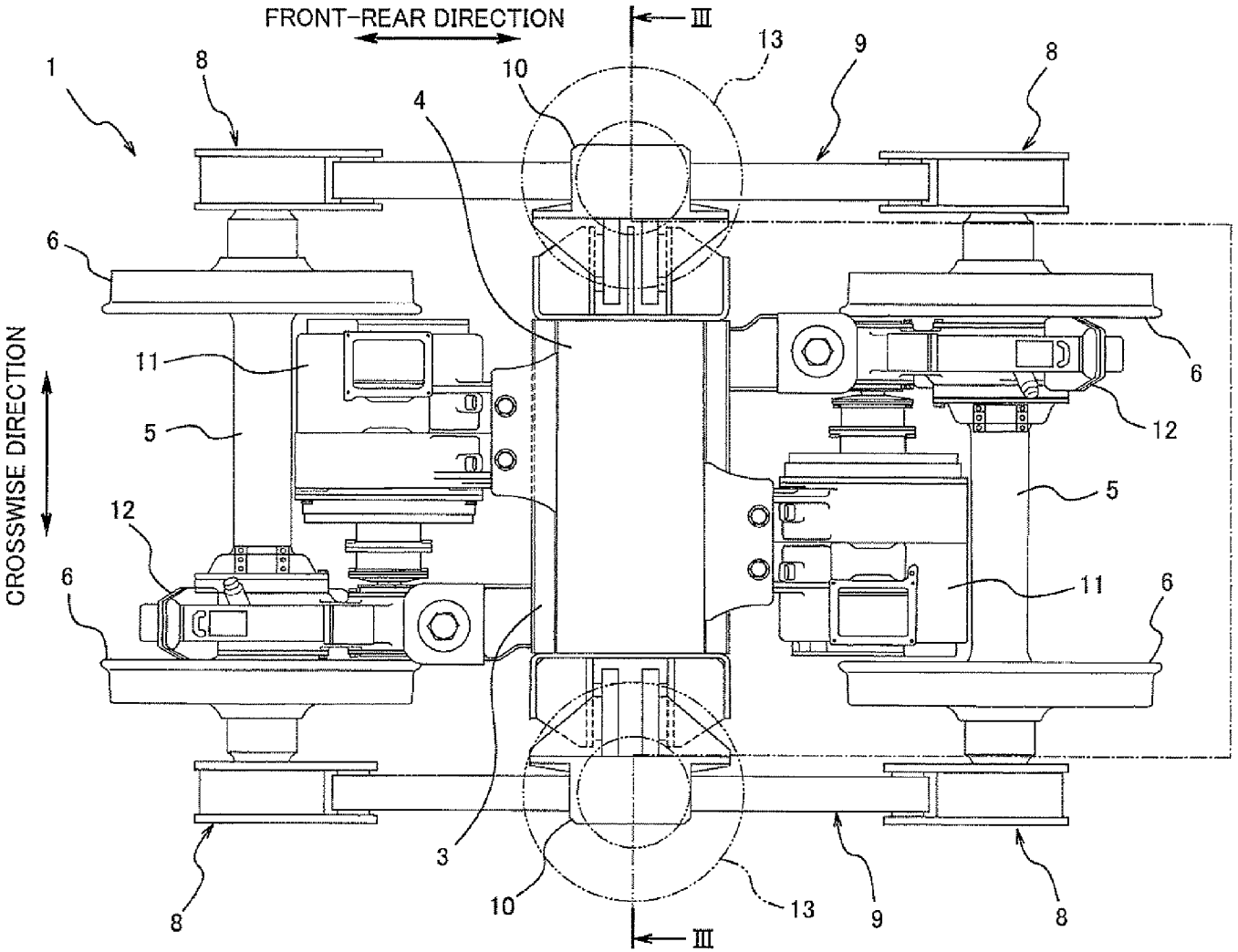
FIG. 1 is a plan view of a railcar bogie according to Embodiment 1 of the present invention.
Figure 2:
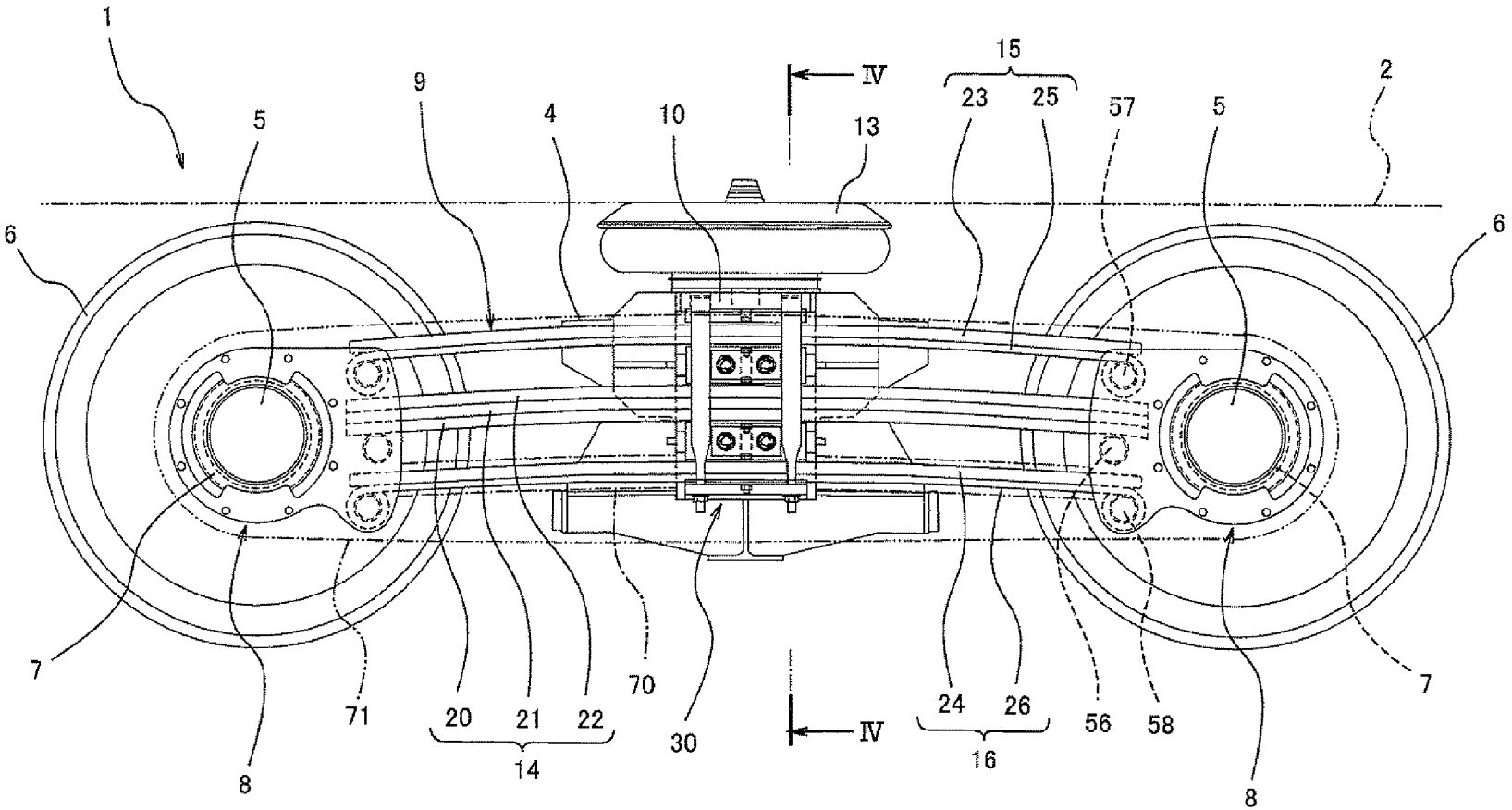
FIG. 2 is a side view of the railcar bogie shown in FIG. 1.
Figure 3:
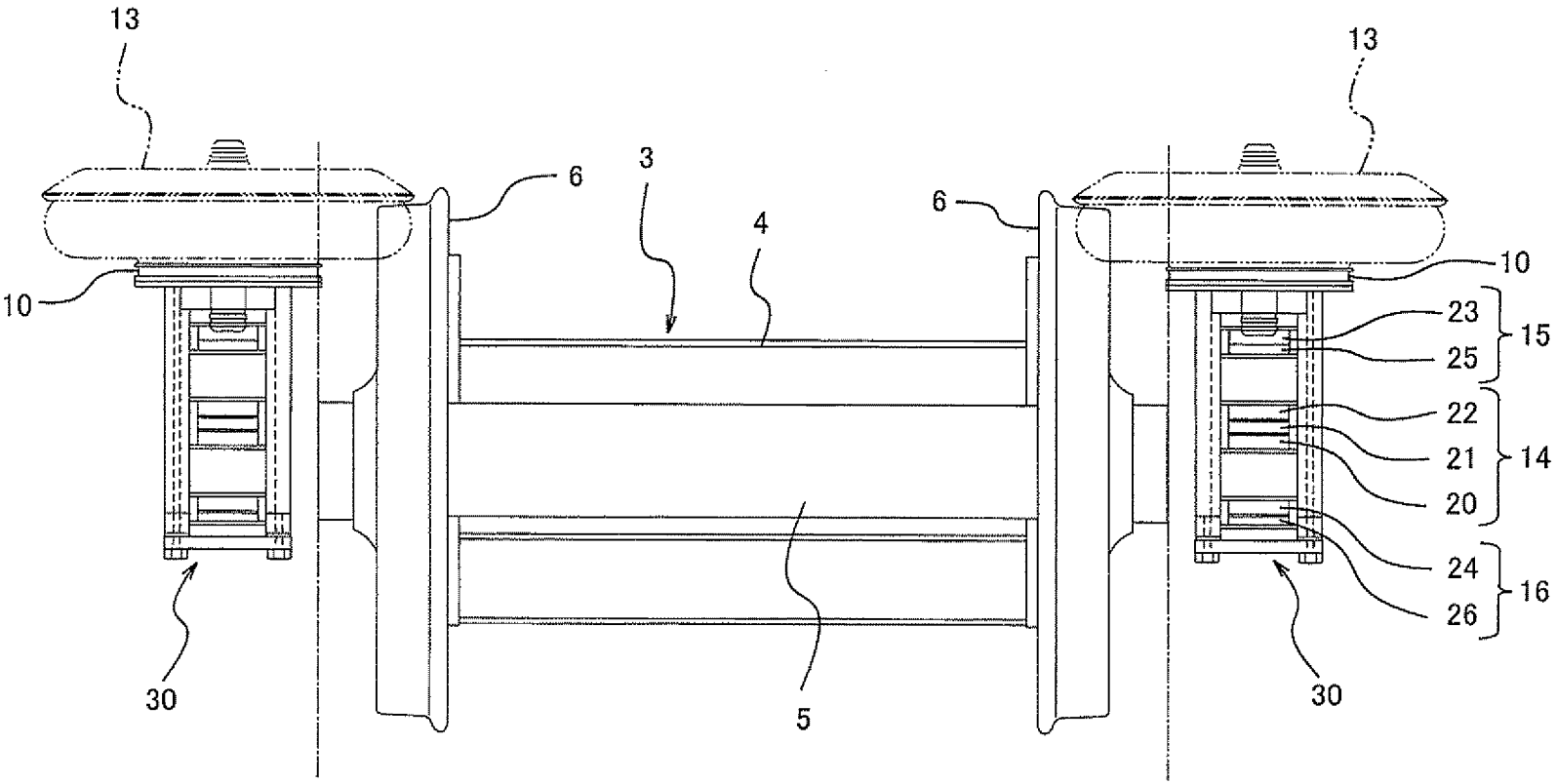
FIG. 3 is a cross-sectional view taken along line III-III of FIG. 1 and shows the railcar bogie.

FIG. 1 is a plan view of a railcar bogie 1 according to Embodiment 1 of the present invention. FIG. 2 is a side view of the railcar bogie 1 shown in FIG. 1. FIG. 3 is a cross-sectional view taken along line III-III of FIG. 1 and shows the railcar bogie 1. As shown in FIGS. 1 to 3, the railcar bogie 1 includes a cross beam 4 extending in a crosswise direction as a bogie frame 3 configured to support a carbody 2 but does not include side sills respectively extending from both end portions of the cross beam 4 in a front-rear direction. A pair of front and rear axles 5 are respectively provided on front and rear sides of the cross beam 4 so as to extend along the crosswise direction. Wheels 6 are respectively fixed to both crosswise-direction sides of each of the axles 5. Bearings 7 configured to rotatably support the axles 5 are respectively provided at both crosswise-direction end portions of each of the axles 5 so as to be each located on an outer side of each of the wheels 6 in the crosswise direction. The bearings 7 are respectively accommodated in bearing accommodating portions 8. Electric motors 11 are attached to the cross beam 4, and gear boxes 12 each of which accommodates a reduction gear for transmitting power to the axle 5 are respectively connected to output shafts of the electric motors 11. The electric motor 11 and the gear box 12 are connected to each other such that the axle 5 can be slightly displaced with respect to the cross beam 4, that is, a slight backlash is present or elasticity is present. A braking device (not shown) configured to brake the rotation of the wheels 6 is also provided at the cross beam 4.

A plurality of plate springs 9 extending in the front-rear direction are provided so as to be located between the cross beam 4 and each of the bearing accommodating portions 8. Front-rear-direction center portions of the plate springs 9 are respectively supported by both crosswise-direction end portions of the cross beam 4, and both front-rear-direction end portions of each of the plate springs 9 are respectively supported by the bearing accommodating portions 8. To be specific, the plurality of plate springs 9 have both the function of a primary suspension and the function of conventional side sills (the bearing accommodating portions 8 are connected to both crosswise-direction end portions of the cross beam 4 by using only the plate springs 9). The plate springs 9 include: a plurality of middle plate springs 14; a plurality of upper plate springs 15 provided above and spaced apart from the middle plate springs 14; and lower plate springs 16 provided under and spaced apart from the middle plate springs 14.

Each of the upper plate springs 15 includes: one coupling plate spring 25 having both front-rear-direction end portions respectively coupled to the bearing accommodating portions 8; and one non-coupling plate spring 23 having both front-rear-direction end portions whose movements in the front-rear direction are not restricted. The non-coupling plate spring 23 is stacked on an upper surface of the coupling plate spring 25 in a surface-contact state. Each of the lower plate springs 16 includes: one coupling plate spring 26 having both front-rear-direction end portions respectively coupled to the bearing accommodating portions 8; and one non-coupling plate spring 24 having both front-rear-direction end portions whose movements in the front-rear direction are not restricted. The non-coupling plate spring 24 is stacked on an upper surface of the coupling plate spring 26 in a surface-contact state. Each of the middle plate springs 14 includes three non-coupling plate springs 20 to 22 each having both front-rear-direction end portions whose movements in the front-rear direction are not restricted. The non-coupling plate springs 20 to 22 are stacked on one another in a surface-contact state. That is, the middle plate spring 14 does not include a coupling plate spring. The entire spring constant of the non-coupling plate springs 20 to 24 is larger than the entire spring constant of the coupling plate springs 25 and 26. The coupling plate springs 25 and 26 are made of metal, and the non-coupling plate springs 20 to 24 are made of fiber-reinforced resin. However, one or more or all of the non-coupling plate springs 20 to 24 may be made of metal.

In an empty state where no passengers are on the carbody 2, each of the plate springs 9 is bent in a substantially circular-arc shape so as to be convex upward in a side view. To be specific, each of the plate springs 9 is formed in a curved shape such that both front-rear-direction end portions thereof are located lower than the front-rear-direction center portion thereof. In addition, the entire spring constant of the plate springs 9 is set such that even when the vehicle occupancy of the carbody 2 is 100% and the plate springs 9 are bent, each of the plate springs 9 maintains the bent state so as to be convex upward in a side view. The coupling plate springs 25 and 26 couple the bearing accommodating portion 8 on a front side and the bearing accommodating portion 8 on a rear side, and the bearing accommodating portion 8 on the front side and the bearing accommodating portion 8 on the rear side are relatively movable in the front-rear direction. Therefore, the coupling plate springs 25 and 26 located on a left side of the bogie 1 and the coupling plate springs 25 and 26 located on a right side of the bogie 1 can elastically deform by different curvatures depending on a load.

The front-rear-direction center portions of the plate springs 9 are respectively positioned and held by holders 30. The holders 30 are respectively attached to holder supporting portions 10 respectively provided at both crosswise-direction end portions of the cross beam 4. Air springs 13 configured to serve as secondary suspensions are respectively mounted on the holder supporting portions 10, and the carbody 2 is mounted on the air springs 13. Partial covers 70 each configured to cover the lower plate spring 16 are respectively provided at the lower plate springs 16 to prevent obstacles (such as stepping stones) from hitting the lower plate springs 16. Instead of the partial covers 70 or in addition to the partial covers 70, entire covers 71 each configured to entirely cover the bearing accommodating portions 8 and the plate springs 14 to 16 from an outer side in the crosswise direction may be provided at the bogie 1. By these entire covers 71, the above components are protected from the obstacles, and the design of the bogie 1 can be improved.

Figure 4:
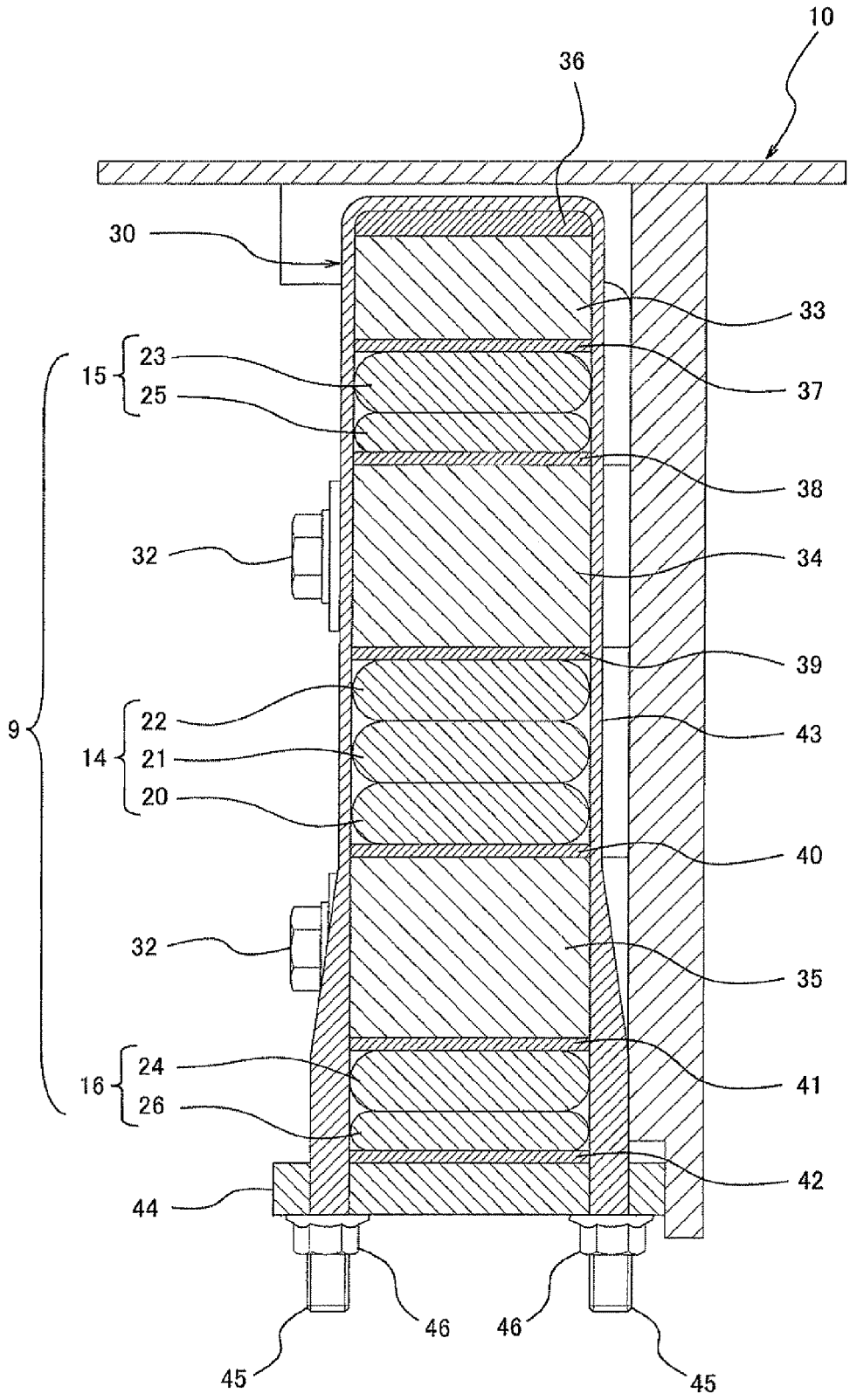
FIG. 4 is a cross-sectional view taken along line IV-IV of FIG. 2 and shows a holder and its periphery.

FIG. 4 is an important portion enlarged view showing a cross section taken along line IV-IV of FIG. 2 and shows the holder 30 and its periphery. As shown in FIG. 4, the holder 30 positions and holds the front-rear-direction center portions of the plurality of plate springs 9 and is fixed to the holder supporting portion 10 of the cross beam 4 by bolts 32. The holder 30 includes: a frame portion 43 having an inverted U-shaped cross section whose lower portion is open; bolts 45 projecting downward from a lower end portion of the frame portion 43; spacers 33 to 35 and rubber plates 36 to 42 provided in a space surrounded by the frame portion 43; a closing plate 44 through which the lower end portion of the frame portion 43 is inserted and which closes a lower end opening of the frame portion 43; and nuts 46 fixed to the bolt 45 such that the closing plate 44 is pressed upward.

Specifically, the rubber plate 36, the spacer 33, and the rubber plate 37 are stacked in this order from an upper side so as to be provided between an upper wall portion of the frame portion 43 and the upper plate spring 15. The rubber plate 38, the spacer 34, and the rubber plate 39 are stacked in this order from the upper side so as to be provided between the upper plate spring 15 and the middle plate spring 14. The rubber plate 40, the spacer 35, and the rubber plate 41 are stacked in this order from the upper side so as to be provided between the middle plate spring 14 and the lower plate spring 16. The rubber plate 42 is provided between the lower plate spring 16 and the closing plate 44. By fastening the nuts 46 to cause the closing plate 44 to move upward, the front-rear-direction center portions of the plate springs 9 are compressed, sandwiched, and strongly restrained. To be specific, the plurality of plate springs 9 are held at predetermined positions by the holders 30, and the holders 30 and the plurality of plate springs 9 constitute a subassembly. The rubber plate 36 may be omitted.

Figure 5:
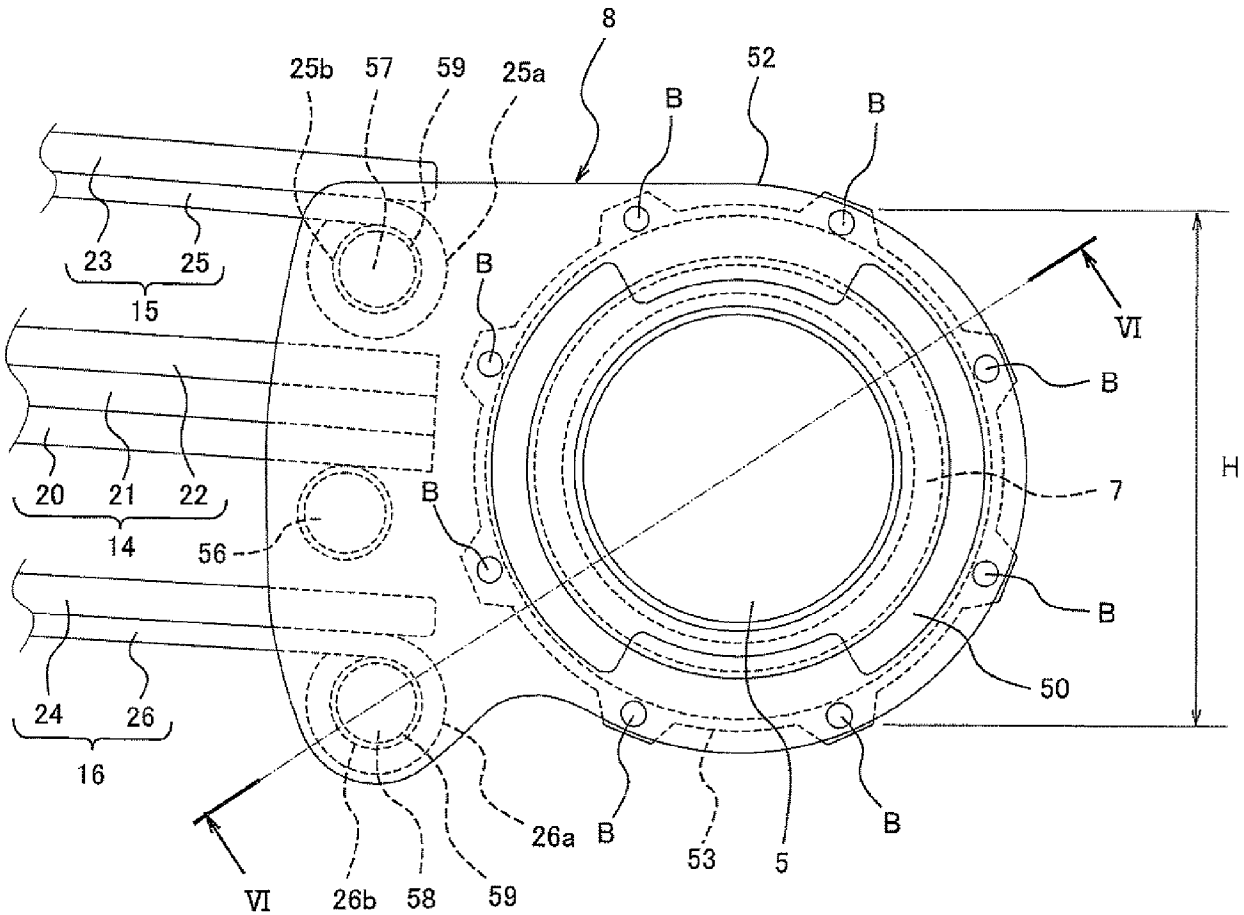
FIG. 5 is an enlarged view of important portions of the railcar bogie shown in FIG. 2.
Figure 6:
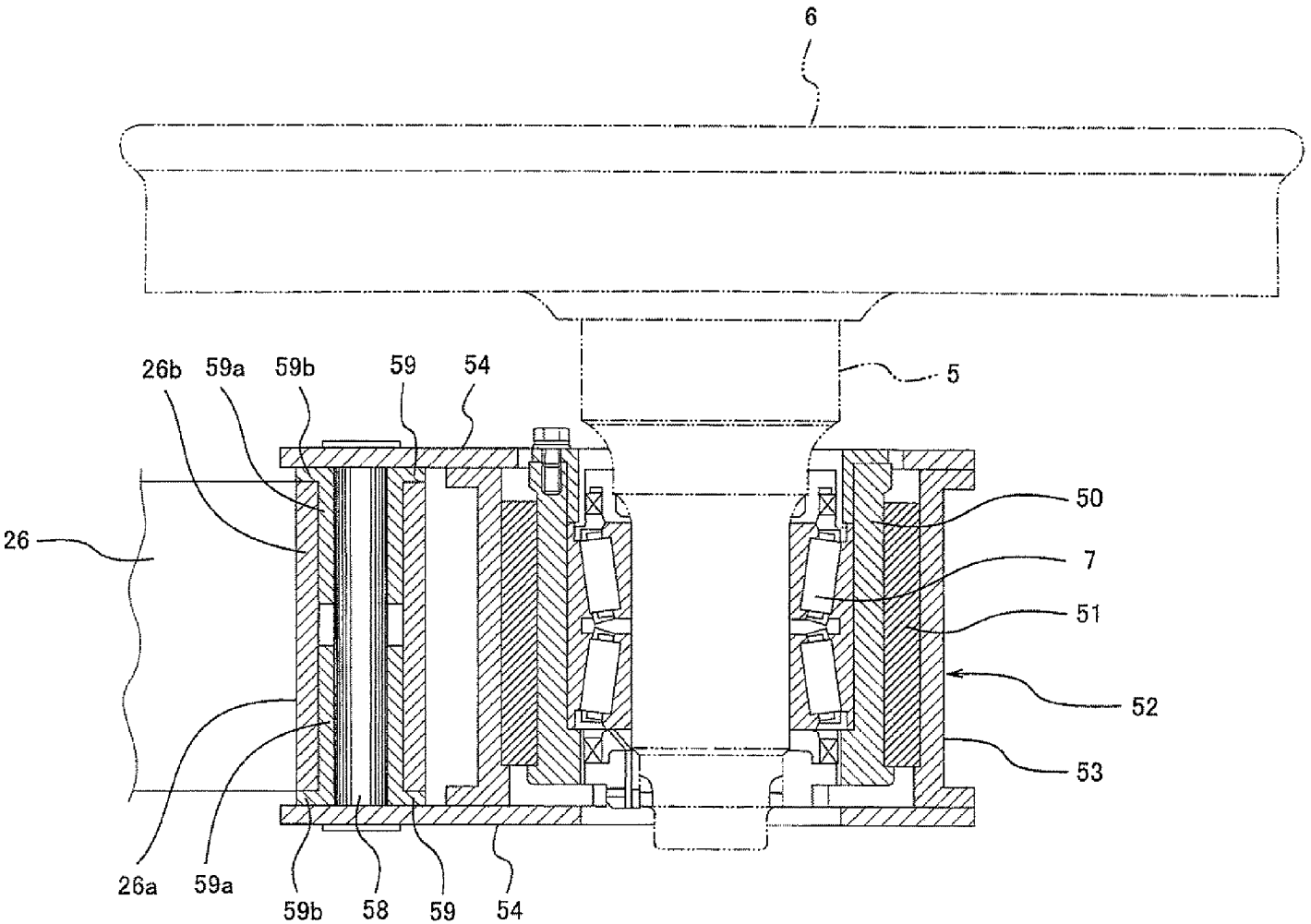
FIG. 6 is a cross-sectional view taken along line VI-VI of FIG. 5 and shows a bearing accommodating portion.

FIG. 5 is an enlarged view of important portions of the railcar bogie 1 shown in FIG. 2. FIG. 6 is a cross-sectional view taken along line VI-VI of FIG. 5 and shows the bearing accommodating portion 8. As shown in FIGS. 5 and 6, the bearing accommodating portion 8 includes: an axle box 50 configured to accommodate the bearing 7; an axle box receiver 52 configured to support the axle box 50; and a tubular rubber block 51 that is an elastic member provided between the axle box 50 and the axle box receiver 52 and configured to be elastically deformable in the front-rear direction and the crosswise direction. A clearance is formed between the axle box receiver 52 and the axle box 50 such that the axle box receiver 52 is displaceable with respect to the axle box 50 in the front-rear direction and the crosswise direction. The axle box receiver 52 includes: a case portion 53 configured to accommodate the axle box 50; a pair of plate portions 54 respectively projecting from both crosswise-direction sides of the case portion 53 toward a center side in the front-rear direction (toward a left side in FIGS. 5 and 6) of the bogie 1; and columnar metal pins 56 to 58 (supporting portions) each extending between the pair of plate portions 54 so as to project from the plate portion 54 in the crosswise direction.

The case portion 53 of the axle box receiver 52 accommodates the axle box 50 to indirectly accommodate the bearing 7. To be specific, the axle box 50 and the case portion 53 constitute a case member configured to accommodate the bearing 7 of the bearing accommodating portion 8. A crosswise-direction interval between a pair of plate portions 54 is set to be slightly larger than a crosswise-direction width of the plate spring 9. The pins 56 to 58 are attached to the plate portions 54 so as to overlap one another in plan view and be vertically spaced apart from one another. Each of the pins 56 to 58 is provided at a height overlapping a height range H between upper and lower ends of the case portion 53. The pins 56 to 58 may be provided such that the pins 57 and 58 overlap each other in plan view, and the pin 56 does not overlap with the pins 57 and 58 in plan view. Depending on the requirement of design, each of the pins 56 to 58 may be provided at a height located on an upper or lower side of the height range H.

Tubular portions 25*a* are respectively formed at both front-rear-direction end portions of the coupling plate spring 25 of the upper plate spring 15, and each of the tubular portions 25*a* forms a pin hole 25*b* by folding and bending downward the end portion of the coupling plate spring 25. Tubular portions 26*a* are respectively formed at both front-rear-direction end portions of the coupling plate spring 26 of the lower plate spring 16, and each of the tubular portions 26*a* forms a pin hole 26*b* by folding and bending downward the end portion of the coupling plate spring 26. The upper pins 57 are respectively, rotatably inserted in the pin holes 25*b* of the tubular portions 25*a*, and the lower pins 58 are respectively, rotatably inserted in the pin holes 26*b* of the tubular portions 26*a*. A pair of sleeves 59 made of resin are provided each of between the pin 57 and the tubular portion 25*a* and between the pin 58 and the tubular portion 26*a*. Each of the sleeves 59 includes: a tube-shaped portion 59*a* in which the pin 57 or 58 fits; and a flange portion 59*b* projecting in a radially outer direction from a crosswise-direction outer end portion of the tube-shaped portion 59*a*. The flange portions 59*b* are respectively provided between the tubular portion 25*a* of the coupling plate spring 25 and the plate portion 54 and between the tubular portion 26*a* of the coupling plate spring 26 and the plate portion 54. Thus, the tubular portion 25*a* of the coupling plate spring 25 is coupled to the pin 57 so as to be rotatable around a rotating axis extending in the crosswise direction, and the pin 57 supports the coupling plate spring 25. Moreover, the tubular portion 26*a* of the coupling plate spring 26 is coupled to the pin 58 so as to be rotatable around a rotating axis extending in the crosswise direction, and the pin 58 supports the coupling plate spring 26.

Each of both front-rear-direction end portions of the non-coupling plate spring 23 stacked on the coupling plate spring 25 is supported by the coupling plate spring 25 so as to be movable in the front-rear direction and is not coupled to the pin 57. Each of both front-rear-direction end portions of the non-coupling plate spring 24 stacked on the coupling plate spring 26 is supported by the coupling plate spring 26 so as to be movable in the front-rear direction and is not coupled to the pin 58. The middle plate spring 14 is constituted by the non-coupling plate springs 20 to 22. Each of both front-rear-direction end portions of the non-coupling plate spring 20 that is a lowermost layer in the middle plate spring 14 that is a group of plate springs stacked on one another is supported by the middle pin 56 so as to be movable in the front-rear direction. To be specific, none of the plate springs 20 to 22 of the middle plate spring 14 is coupled to the pin 56.

As shown in FIGS. 2 and 5, each of the plurality of plate springs 9 is supported by the pin 56, 57, or 58 (supporting portions) on a center side of the axle 5 in the front-rear direction of the bogie 1. To be specific, the length of each of the plate springs 9 in the front-rear direction is shorter than the distance between the front and rear axles 5. Each of the pins 56 to 58 is provided at a height overlapping the height range H between the upper and lower ends of the case portion 53 of the bearing accommodating portion 8, and a vertical distance between the uppermost plate spring 23 and the lowermost plate spring 26 is also short. In plan view, the plate spring 9 is bent in a substantially circular-arc shape so as to be convex upward. Regarding the plate spring 9, both front-rear-direction end portions each supported by the pin 56, 57, or 58 are located lower than the front-rear-direction center portion supported by the holder 30. If a downward load applied to the front-rear-direction center portion of the plate spring 9 increases, the plate spring 9 elastically deforms so as to become a substantially linear shape in plan view. With this, the distance between the front and rear axles 5 in the front-rear direction increases. The entire thickness of the middle plate spring 14 is larger than each of the entire thickness of the upper plate spring 15 and the entire thickness of the lower plate spring 16. The thickness of each of the non-coupling plate springs 20 to 24 is larger than the thickness of each of the coupling plate springs 25 and 26.

According to the configuration explained above, since the plate spring 9 is supported by the pin 56, 57, or 58 of the bearing accommodating portion 8 on the center side of the axle 5 in the front-rear direction, the length of the plate spring 9 in the front-rear direction can be reduced. Thus, even if the weight of the carbody is large, a preferable spring constant can be realized without excessively increasing the thickness of the plate spring 9. A position where the plate spring 9 is supported by the bearing accommodating portion 8 is not a position immediately below the axle 5 but a position located on the center side of the axle 5 in the front-rear direction and on a side of the case portion 53. Therefore, the distance between the lowermost plate spring 26 and the ground can be adjusted so as not to be too short. Thus, the running of the railcar is not adversely affected. For example, the obstacles and the like do not contact the plate spring 26. In addition, the position where the plate spring 9 is supported by the bearing accommodating portion 8 is not a position immediately above the axle 5 but a position located on the center side of the axle 5 in the front-rear direction and on a side of the case portion 53. Therefore, the uppermost plate spring 23 can be provided at a low position, and this can lower the position of the cross beam 4. Thus, the low floor of the carbody 2 can be realized.

Figure 7:
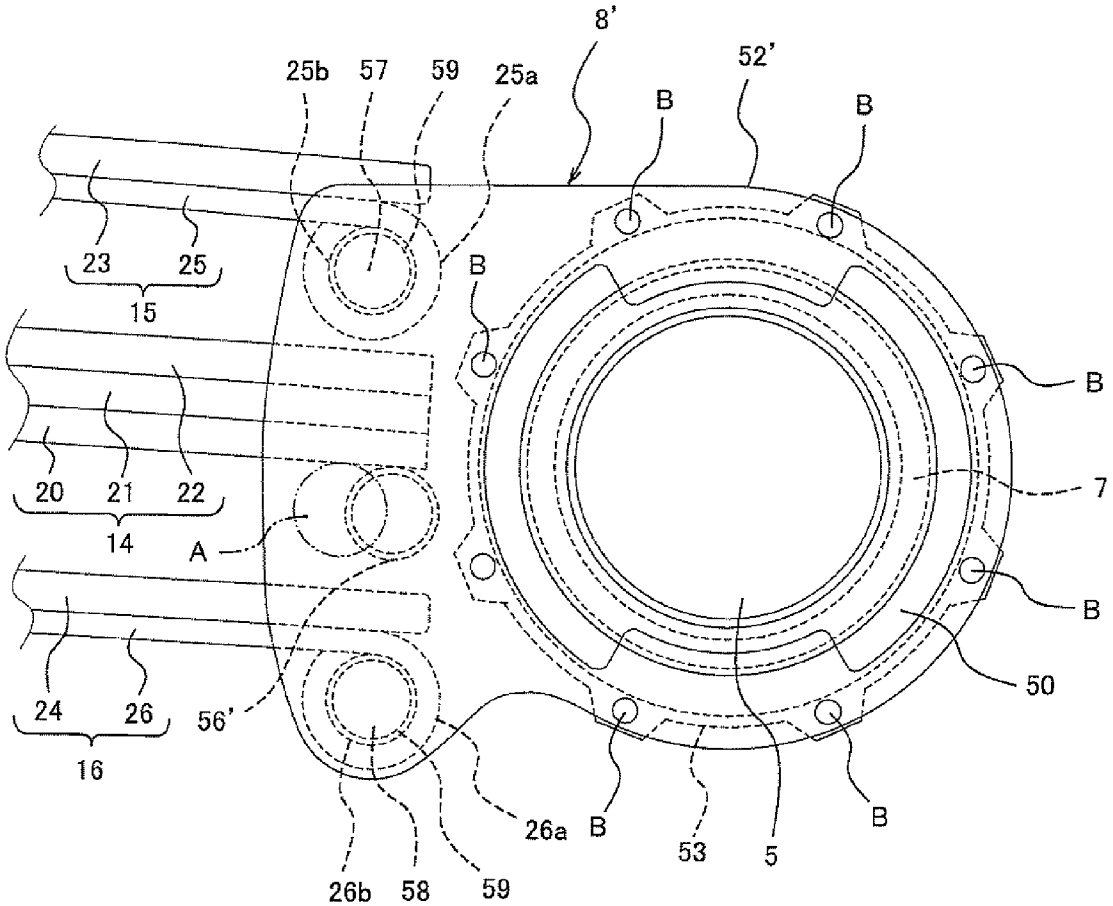
FIG. 7 is a diagram showing Modification Example of the bearing accommodating portion shown in FIG. 5.

As shown in FIG. 7, the spring constant of the non-coupling plate springs 20 to 22 can be changed only by causing the position of a pin 56' relative to an axle box receiver 52' to move in the front-rear direction from an original position A (that is the position of the pin 56 in FIG. 5) without changing the other members, the pin 56' supporting the non-coupling plate springs 20 to 22. For example, if the position of the pin 56 is moved to the center side in the front-rear direction of the bogie, the length of a portion, which contributes to the elastic force, of the middle plate spring 14 in the front-rear direction decreases. Thus, the stiffness of the middle plate spring 14 increases, and the spring constant suitable for the bogie in which the spring weight is large (for example, a bogie used for a motor car) is realized. In contrast, if the position of the pin 56' is moved to the outer side of the bogie in the front-rear direction, the length of the portion, which contributes to the elastic force, of the middle plate spring 14 in the front-rear direction increases. Thus, the stiffness of the middle plate spring 14 decreases, and the spring constant suitable for the bogie in which the spring weight is small (for example, a bogie used for a trail-car) is realized. Therefore, the spring constant can be adjusted only by changing the position of the pin 56. Thus, the design efficiency and the producibility extremely improve. The change of the position of the pin is not limited to the pin 56 for the middle plate spring 14. The same effect as above can be obtained by changing the position of the pin 57 for the upper plate spring 15 and/or the pin 58 for the lower plate spring 16. However, in such case, the length of the coupling plate spring 25 or 26 in the front-rear direction needs to be changed.

Figure 8:
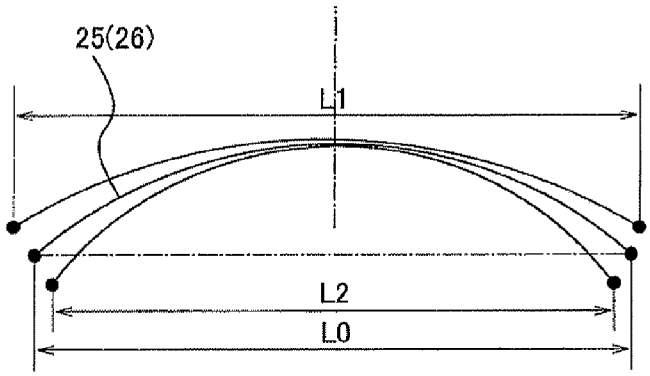
FIG. 8 is a schematic diagram for explaining elastic deformation of a coupling plate spring shown in FIG. 2.
Figure 9:
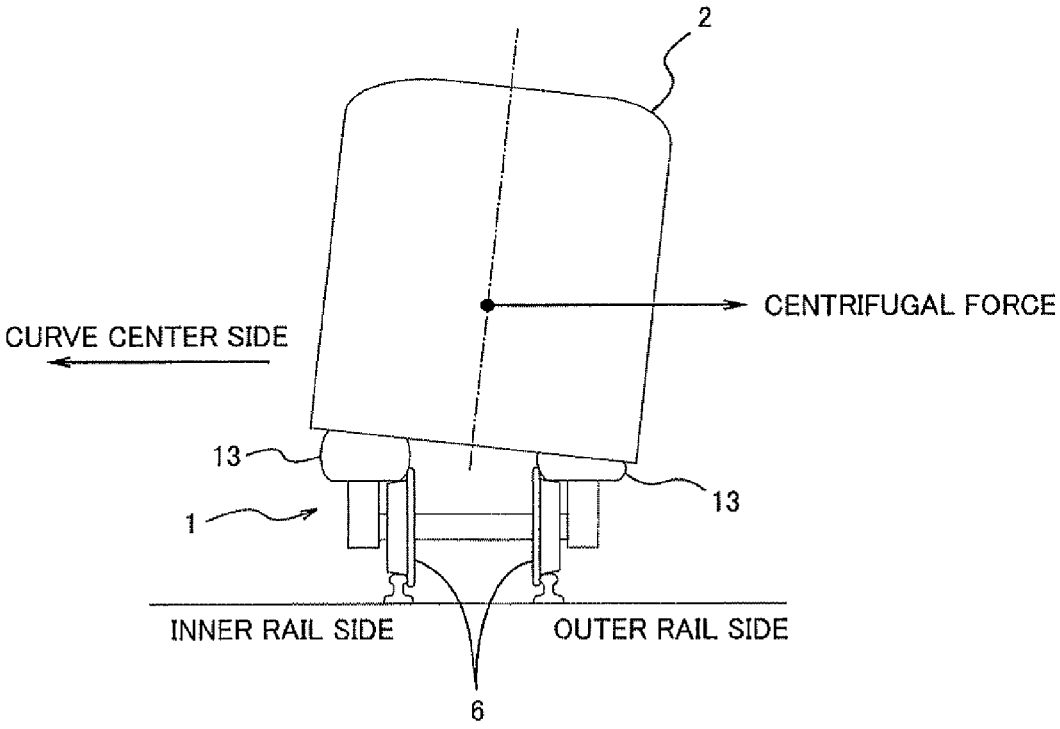
FIG. 9 is a rear view for explaining curve running of the railcar bogie shown in FIG. 1.
Figure 10:
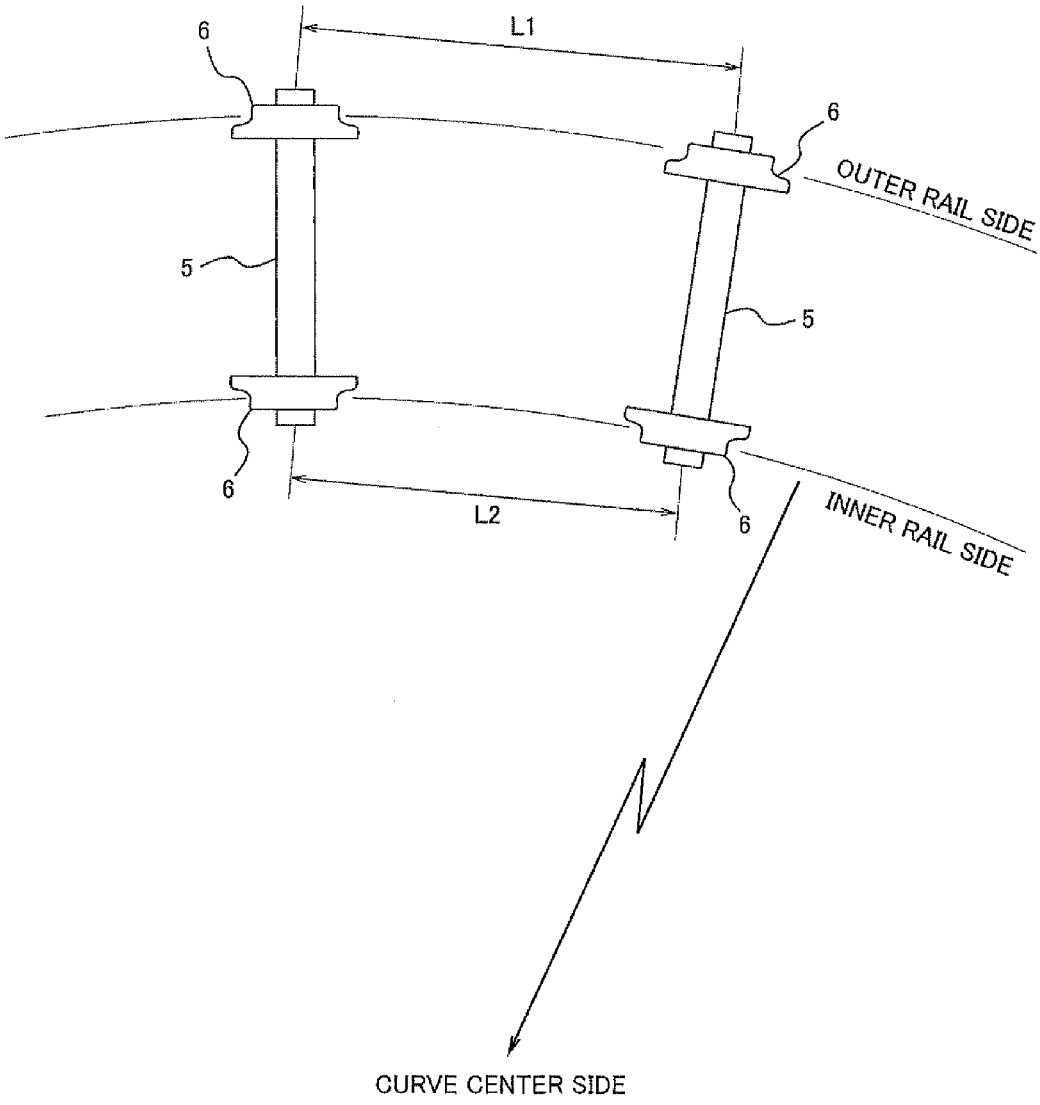
FIG. 10 is a schematic plan view for explaining the curve running of the railcar bogie shown in FIG. 1.

As shown in FIG. 8, when a downward load applied to the front-rear-direction center portion of each of the plate springs 25 and 26 each of which is bent so as to be convex upward in a side view increases, each of the plate springs 25 and 26 elastically deforms such that the curvature thereof is decreased in a side view, and the distance between the front and rear axles 5 in the front-rear direction increases from a normal distance L0 to a distance L1 (for example, L1−L0≤20 mm). In contrast, when the downward load applied to the front-rear-direction center portion of the plate spring 9 decreases, the plate spring 9 elastically deforms such that the curvature thereof is increased in a side view, and the distance between the front and rear axles 5 in the front-rear direction decreases from the normal distance L0 to a distance L2 (for example, L0−L2≤20 mm). As shown in FIGS. 9 and 10, when the railcar bogie 1 runs around a curve and centrifugal force acts on the carbody 2, a wheel load of the wheel 6 on a curve inner side (inner rail side) becomes lower than the wheel load of the wheel 6 on a curve inner side (outer rail side), and the load applied to the plate spring 9 on the outer rail side becomes higher than the load applied to the plate spring 9 on the inner rail side. Therefore, the distance L1 between the axles on the outer rail side becomes larger than the distance L2 between the axles on the inner rail side. Thus, a self-steering function of the wheel 6 is achieved. Therefore, lateral pressure of the wheel 6 at the time of the curve running can be reduced, and the performance of running through a curved line improves.

Since the coupling plate springs 25 and 26 are respectively, rotatably coupled to and supported by the pins 57 and 58, the elastic deformation of the plate springs 9 is smoothly performed. In addition, since the tubular portions 25*a* and 26*a* of the pins 57 and 58 are made of metal, and the sleeves 59 are made of resin, rotation sliding resistances of the tubular portions 25*a* and 26*a* with respect to the pins 57 and 58 can be reduced.

By providing the non-coupling plate springs 20 to 24, the entire spring constant of the plate springs 9 can be easily adjusted without increasing the thicknesses of the coupling plate springs 25 and 26. In addition, each of the non-coupling plate springs 21 to 24 is stacked on an upper surface of the plate spring 20, 21, 25, or 26 by surface contact. Therefore, when the entire plate springs 9 bend, sliding friction occurs among the plate springs 20 to 26 stacked by surface contact. Thus, a moderate damping effect can be obtained.

Since the entire spring constant of the non-coupling plate springs 20 to 24 is larger than the entire spring constant of the coupling plate springs 25 and 26, and the thickness of each of the coupling plate springs 25 and 26 is not excessively large, the workability of the coupling plate springs 25 and 26 is excellent, and the spring constant can be easily adjusted by the non-coupling plate springs 20 to 24. Further, since the coupling plate springs 25 and 26 are made of metal, and the non-coupling plate springs 20 to 24 are made of fiber-reinforced resin, the entire plate springs 9 can be reduced in weight while improving the workability and the like of the coupling plate springs 25 and 26.

Since the middle plate spring 14, the upper plate spring 15, and the lower plate spring 16 are positioned and held by the holder 30 so as to be spaced apart from one another in the vertical direction, the holder 30 and the entire plate springs 9 constitute a modularized subassembly. Thus, an assembly work property improves. Further, a force of sandwiching the plate springs 9 by the holder 30 can be adjusted only by adjusting the nuts 46, the maintenance of the plate springs 9 can be easily performed.

Figure 11:
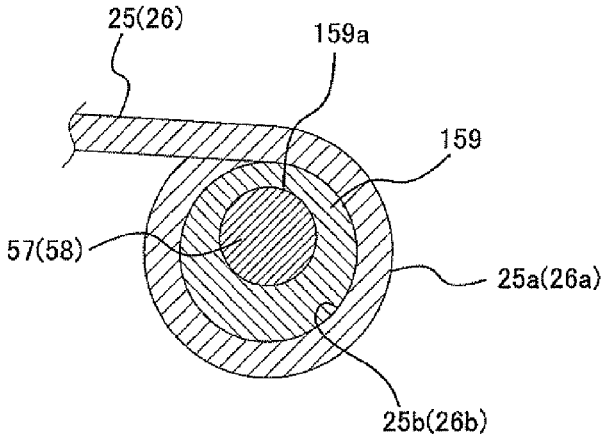
FIG. 11 is a diagram showing Modification Example 1 of a coupling portion of the coupling plate spring shown in FIG. 5.
Figure 12:
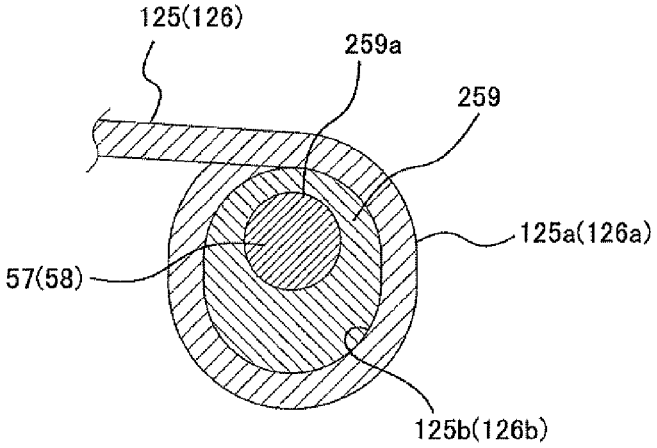
FIG. 12 is a diagram showing Modification Example 2 of the coupling portion of the coupling plate spring shown in FIG. 5.
Figure 13:
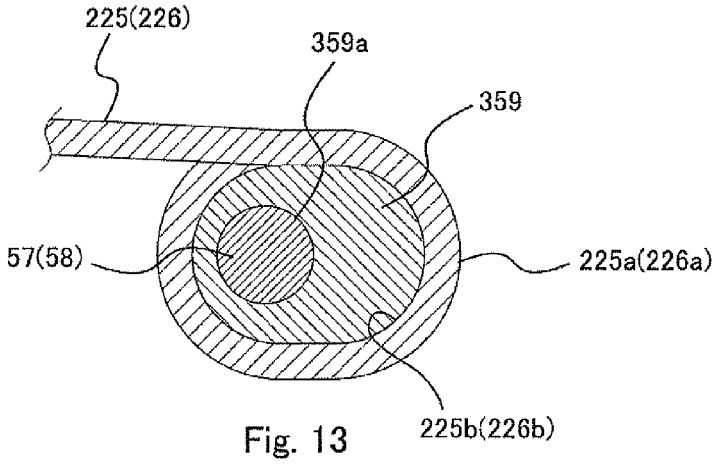
FIG. 13 is a diagram showing Modification Example 3 of the coupling portion of the coupling plate spring shown in FIG. 5.

As shown in FIGS. 11 to 13, each of the sleeves configured to respectively, externally fit the pins 57 and 58 may be formed in a special shape. With this, the adjustment of respective wheel loads in the bogie (respective wheel loads of the same vehicle are required to fall within a certain range) and the adjustment of the spring constant in accordance with the aged deterioration of the plate spring can be performed. For example, as shown in FIG. 11, the pin holes 25*b* and 26*b* of the tubular portions 25*a* and 26*a* of the coupling plate springs 25 and 26 are increased in diameter, and sleeves 159 each including a pin hole 159*a* decentered in the vertical direction are respectively inserted into the tubular portions 25*a* and 26*a*. With this, the spring constants of the plate springs 25 and 26 can be adjusted by adjusting the height of the tubular portion 25*a* relative to the pin 57 and the height of the tubular portion 26*a* relative to the pin 58. In this case, to prevent the sleeve 159 from rotating relative to the tubular portion 25*a* or 26*a*, a stopper structure, not shown, may be provided.

As shown in FIG. 12, each of tubular portions 125*a* and 126*a* of coupling plate springs 125 and 126 is formed in a vertical oval shape, and oval-shaped sleeves 259 each including a pin hole 259*a* decentered in the vertical direction are respectively inserted into the tubular portions 125*a* and 126*a*. With this, the spring constants of the plate springs 125 and 126 may be adjusted by adjusting the height of the tubular portion 125*a* relative to the pin 57 and the height of the tubular portion 126*a* relative to the pin 58. In this case, even if the stopper structure is not provided, the sleeves 259 do not rotate relative to the tubular portions 125*a* and 126*a*. As shown in FIG. 13, each of tubular portions 225*a* and 226*a* of coupling plate springs 225 and 226 is formed in a lateral oval shape, and oval-shaped sleeves 359 each including a pin hole 359*a* decentered in the front-rear direction (left-right direction in FIG. 13) are respectively inserted into the tubular portions 225*a* and 226*a*. With this, the spring constants of the plate springs 225 and 226 may be adjusted by adjusting the position of the tubular portion 225*a* relative to the pin 57 in the front-rear direction and the position of the tubular portion 226*a* relative to the pin 58 in the front-rear direction.

Embodiment 2

Figure 14:
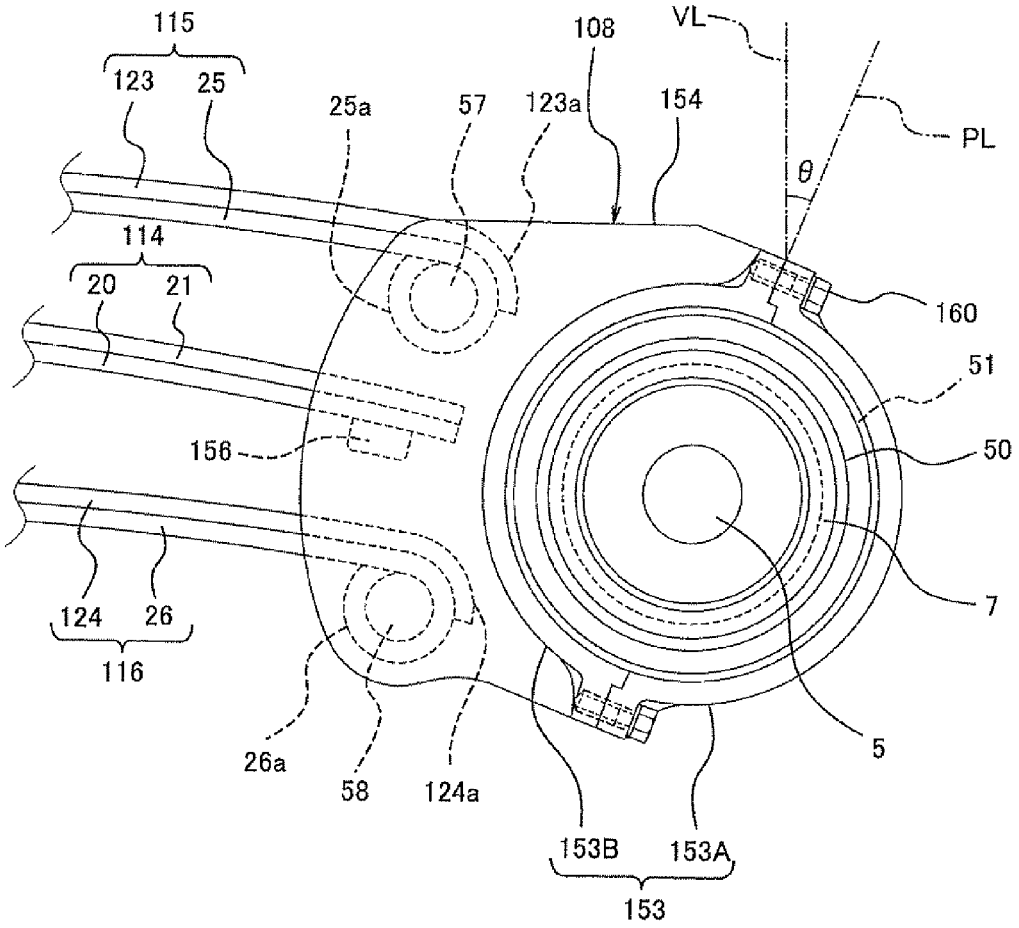
FIG. 14 is a diagram of the railcar bogie according to Embodiment 2 of the present invention and corresponds to FIG. 5.

FIG. 14 is a diagram of the railcar bogie according to Embodiment 2 of the present invention and corresponds to FIG. 5. The same reference signs are used for the same components as in Embodiment 1, and explanations thereof are omitted. As shown in FIG. 14, in the bogie of the present embodiment, a case portion 153 of a bearing accommodating portion 108 is divided into two parts in a side view. Specifically, the case portion 153 includes a substantially semicircular first divided part 153A and a substantially semicircular second divided part 153B. The case portion 153 having a substantially cylindrical shape is formed by contacting the divided parts 153A and 153B with each other and fastening the divided parts 153A and 153B by bolts 160. A parting line PL of the case portion 153 is inclined at a predetermined angle θ (For example, 10° to 30°) with respect to a vertical line VL.

A plate portion 154 projects toward the center side in the front-rear direction of the bogie from the second divided part 153B located on the center side in the front-rear direction. The pins 57 and 58 each extending in the crosswise direction and having a circular cross section and a supporting plate 156 having a quadrangular cross section are provided at the plate portion 154. A middle plate spring 114 includes two non-coupling plate springs 20 and 21, and both end portions of the non-coupling plate spring 20 that is the lowermost layer are respectively supported by the supporting plates 156 in a surface-contact state so as to be movable in the front-rear direction. An upper plate spring 115 includes the coupling plate spring 25 and a non-coupling plate spring 123, and a lower plate spring 116 includes the coupling plate spring 26 and a non-coupling plate spring 124. Each of both end portions 123*a* of the non-coupling plate spring 123 is formed in a circular-arc shape so as to extend along the tubular portion 25*a*, and each of both end portions 124*a* of the non-coupling plate spring 124 is formed in a circular-arc shape so as to extend along the tubular portion 26*a*. The other components are the same as those in Embodiment 1, so that detailed explanations thereof are omitted.

Embodiment 3

Figure 15:
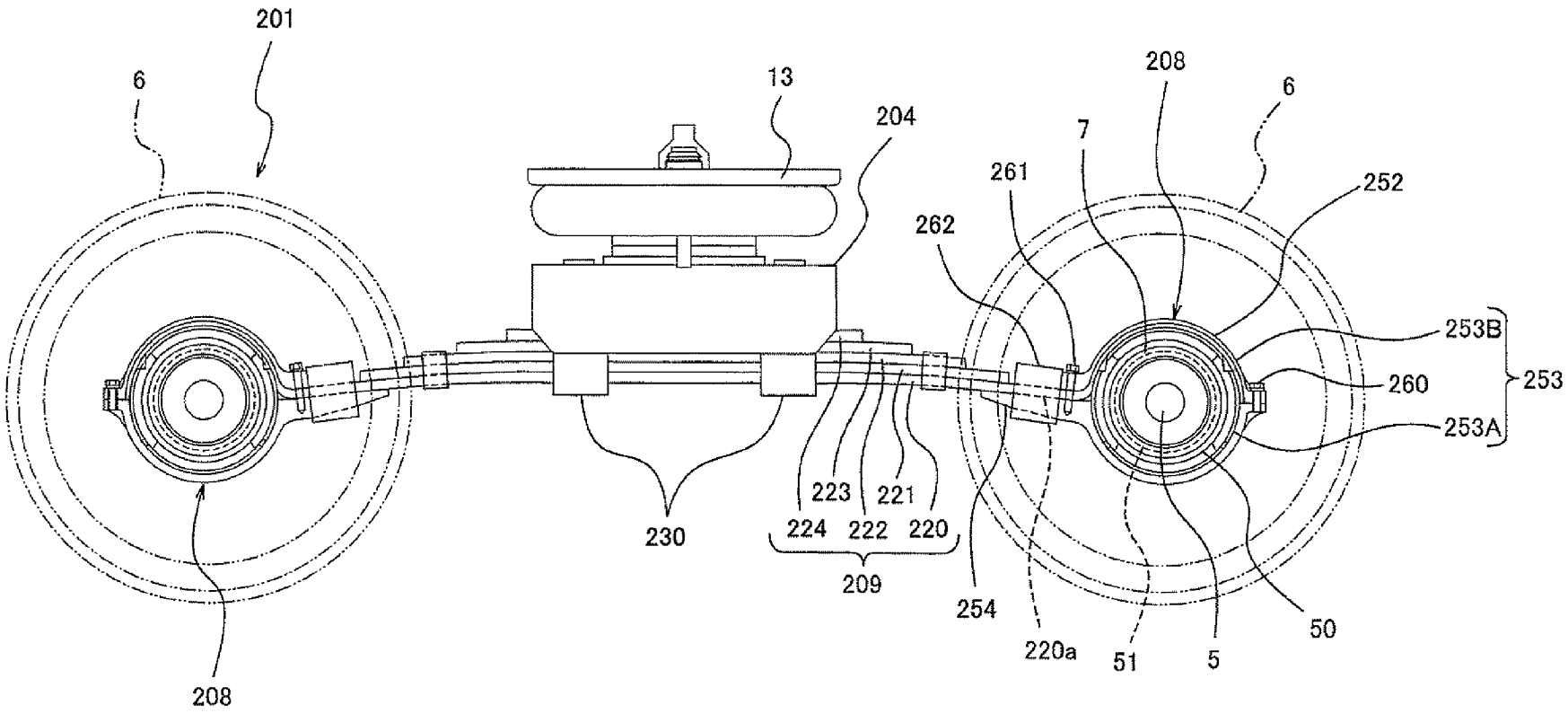
FIG. 15 is a side view of the railcar bogie according to Embodiment 3 of the present invention.

FIG. 15 is a side view of a railcar bogie 201 according to Embodiment 3 of the present invention. The same reference sings are used for the same components as in Embodiment 1, and explanations thereof are omitted. As shown in FIG. 15, in the bogie 201 of the present embodiment, holders 230 configured to hold a plurality of plate springs 209 are attached to each of both crosswise-direction end portions of a cross beam 204 of the bogie frame from which side sills are omitted. The plate springs 209 include one coupling plate spring 220 and a plurality of non-coupling plate springs 221 to 224 stacked on the coupling plate spring 220. Each of the plate springs 220 to 224 is bent in a substantially circular-arc shape so as to be convex upward in a side view. Both front-rear-direction end portions of the plate springs 220 to 224 are formed in a stepwise shape such that the spring located on an upper side is shorter in length in the front-rear direction. Both end portions 220*a* of the coupling plate spring 220 are respectively coupled to bearing accommodating portions 208. A case portion 253 of the bearing accommodating portion 208 is divided into two parts that are an upper part and a lower part in a side view.

Specifically, the case portion 253 includes a substantially semicircular lower divided part 253A and a substantially semicircular upper divided part 253B. The case portion 253 having a substantially cylindrical shape is formed by contacting the divided parts 253A and 253B with each other and fastening the divided parts 253A and 253B by bolts 260 and 261. A supporting plate 254 (supporting portion) projects from the lower divided part 253A toward the center side in the front-rear direction. Both end portions 220*a* of the coupling plate spring 220 are respectively supported by the supporting plates 254. The supporting plate 254 is located on the center side of the axle 5 in the front-rear direction and is provided at a height overlapping a height range between upper and lower ends of the case portion 253. The upper divided part 253B is fixed to the lower divided part 253A by the bolt 261 in a state where each of both end portions 220*a* of the coupling plate spring 220 is sandwiched between the divided parts 253A and 253B. A portion, sandwiched between the divided parts 253A and 253B, of each of both end portions 220*a* of the coupling plate spring 220 is further held by externally banding these components by a banding member 262. Since the other components are the same as those in Embodiment 1 described above, detailed explanations thereof are omitted.

The present invention is not limited to the above-described embodiments, and modifications, additions, and eliminations may be made within the spirit of the present invention. The above embodiments may be combined arbitrarily. For example, some of components or methods in one embodiment may be applied to the other embodiment.

INDUSTRIAL APPLICABILITY

As above, the railcar bogie according to the present invention has an excellent effect of being able to optimize the spring constant of the plate spring. Thus, the present invention is useful when it is widely applied to railcars which can achieve the meaning of the effect.

The invention claimed is:

1. A railcar bogie comprising:

a cross beam configured to support a carbody of a railcar;

a pair of front and rear axles respectively provided on front and rear sides of the cross beam so as to extend along a crosswise direction;

bearings respectively provided on both crosswise-direction sides of each of the axles and configured to rotatably support the axles;

bearing accommodating portions configured to respectively accommodate the bearings; and plate springs extending in a front-rear direction so as to be respectively supported by both crosswise-direction end portions of the cross beam, end portions of each of the plate springs being respectively supported by the bearing accommodating portions, wherein:

the plate springs include a middle plate spring, an upper plate spring provided above and spaced apart from the middle plate spring, and a lower plate spring provided under and spaced apart from the middle plate spring;

supporting portions include a middle supporting portion, an upper supporting portion, and a lower supporting portion;

each of the bearing accommodating portions includes a case portion configured to accommodate the bearing, the middle supporting portion configured to support the middle plate spring, the upper supporting portion configured to support the upper plate spring, and the lower supporting portion configured to support the lower plate spring;

each of the upper plate spring and the lower plate spring includes at least a coupling plate spring;

the middle plate spring consists of one or more non-coupling plate springs;

each of both end portions of the coupling plate spring of the upper plate spring is coupled to and supported by the upper supporting portion so as to be rotatable around a rotating axis extending in the crosswise direction;

each of both end portions of the coupling plate spring of the lower plate spring is coupled to and supported by the lower supporting portion so as to be rotatable around a rotating axis extending in the crosswire direction; and each of both end portions of the one or more non-coupling plate springs of the middle plate spring is supported by the middle supporting portion so as to be movable in the front-rear direction.

2. The railcar bogie according to claim 1, wherein a portion, respectively supported by each of the supporting portions, of each of the plate springs is located lower than a portion, supported by the cross beam, of each of the plate springs.

3. The railcar bogie according to claim 2, wherein:

a front-rear-direction center portion of each of the plate springs is supported by the cross beam, and both front-rear-direction end portions of each of the plate springs are respectively supported by each of the supporting portions; and each of the plate springs is bent in a substantially circular-arc shape so as to be convex upward in a side view.

4. The railcar bogie according to claim 2, wherein:

a distance between the bearing accommodating portion on the front side and the bearing accommodating portion on the rear side changes by elastic deformation of the coupling plate spring, the elastic deformation corresponding to a load.

5. The railcar bogie according to claim 1, wherein:

tubular portions are respectively formed at the both end portions of each of the coupling plate springs so as to each form a pin hole by folding and bending each of the end portions of the coupling plate spring;

each of the bearing accommodating portions further includes a plate portion projecting from the case portion toward the center side in the front-rear direction of the bogie;

each of the supporting portions include a pin projecting from the plate portion in the crosswise direction; and the both end portions of the coupling plate spring are respectively coupled to and supported by the supporting portions such that the pins of the supporting portions are respectively, rotatably inserted into the pin holes of the tubular portions.

6. The railcar bogie according to claim 5, wherein:

each of sleeves is provided between the pin and the tubular portion; and the pins and the tubular portions are made of metal, and the sleeves are made of resin.

7. The railcar bogie according to claim 1, wherein an entire spring constant of the non-coupling plate springs is larger than an entire spring constant of the coupling plate springs.

8. The railcar bogie according to claim 1, wherein:

the coupling plate springs are made of metal; and the non-coupling plate springs include a plate spring made of fiber-reinforced resin.

9. The railcar bogie according to claim 1, wherein:

the plate springs include a plurality of plate springs provided so as to be spaced apart from one another in the vertical direction;

each of holders is attached to the plurality of plate springs so as to collectively position and hold front-rear-direction center portions of the plurality of plate springs; and the holders are respectively fixed to the both end portions of the cross beam.

10. The railcar bogie according to claim 1, wherein each of the bearing accommodating portions includes: an axle box configured to accommodate the bearing; an axle box receiver configured to support the axle box; and an elastic member provided between the axle box and the axle box receiver so as to be elastically deformable in the front-rear direction and the crosswise direction.

11. The railcar bogie according to claim 1, wherein each of the supporting portions is provided at a height overlapping a height range between upper and lower ends of the case portion.

* * * * *